US009257782B2

(12) United States Patent
Gencel

(10) Patent No.: US 9,257,782 B2
(45) Date of Patent: Feb. 9, 2016

(54) ELECTRICAL CONNECTOR WITH MOISTURE ABSORBING PIN

(71) Applicant: FORD OTOMOTIV SANAYI ANONIM SIRKETI, Sancaktepe, Istanbul (TR)

(72) Inventor: Sulhi Gencel, Degirmendere Golcuk/Kocaeli (TR)

(73) Assignee: Ford Otomotiv Sanayi Anonim Sirketi, Sancaktepe, Istanbul (TR)

( * ) Notice: Subject to any disclaimer, the term of this patent is extended or adjusted under 35 U.S.C. 154(b) by 40 days.

(21) Appl. No.: 14/473,056

(22) Filed: Aug. 29, 2014

(65) Prior Publication Data

US 2015/0064951 A1 Mar. 5, 2015

(30) Foreign Application Priority Data

Aug. 29, 2013 (EP) ..... 13182247

(51) Int. Cl.
*H01R 4/60* (2006.01)
*H01R 13/52* (2006.01)
*H01R 13/443* (2006.01)

(52) U.S. Cl.
CPC ..... *H01R 13/5219* (2013.01); *H01R 13/5202* (2013.01); *H01R 13/443* (2013.01)

(58) Field of Classification Search
CPC ..... H01R 13/5227; H01R 33/22; H01R 13/5219; H01R 13/53; H01R 25/00
USPC ..... 439/206, 936, 201, 933, 934, 911
See application file for complete search history.

(56) References Cited

U.S. PATENT DOCUMENTS 5,781,232 A * 7/1998 Ejima ..... H04N 5/772 312/276
6,128,193 A * 10/2000 Moss ..... G05D 22/00 174/50
6,655,975 B1 * 12/2003 Liedtke ..... H01R 13/5216 439/276
7,914,298 B2 * 3/2011 Lauermann ..... H01R 13/5205 439/76.1
7,963,802 B2 * 6/2011 Corneille ..... H01L 31/02008 136/244
8,192,216 B1 6/2012 Puluc et al.
2012/0329317 A1 12/2012 Aoki et al.
2013/0098420 A1 4/2013 Sherman et al.

FOREIGN PATENT DOCUMENTS

WO 2007036369 A1 4/2007

OTHER PUBLICATIONS

European Patent Office, Extended Search Report for European Patent Application No. 13182247.0 mailed Feb. 17, 2014.

* cited by examiner

*Primary Examiner* — Phuong Dinh
(74) *Attorney, Agent, or Firm* — Frank A. MacKenzie; Brooks Kushman P.C.

(57) ABSTRACT

An electrical connector has a casing configured to define a chamber when mated with a mating connector, a plurality of contact pins projecting from the casing into the chamber when mated with the mating connector, and a moisture-absorbing pin retained by the casing for movement between a retracted position wherein the moisture-absorbing pin is substantially enclosed by the casing and an extended position wherein the moisture-absorbing pin extends into the chamber. A fluid is contained within the casing that is compressed by a movement of at least one of the contact pins during engagement of the electrical connector with the mating connector, compression of the fluid urging the moisture absorbing pin from the retracted position to the extended position.

17 Claims, 1 Drawing Sheet

ELECTRICAL CONNECTOR WITH MOISTURE ABSORBING PIN

CROSS-REFERENCE TO RELATED APPLICATIONS

This application claims foreign priority benefits under 35 U.S.C. §119(a)-(d) to EP 13182247.0 filed Aug. 29, 2013, which is hereby incorporated by reference in its entirety.

TECHNICAL FIELD

The invention relates to an electrical connector for mechanical and electrical connection with a mating connector thereof, comprising a plurality of contact pins arranged in parallel to each other which are adapted for engagement with a plurality of associated contact elements mounted to the mating connector in order to make a plurality of independent electrical connections between the contact pins and the associated contact elements, when the electrical connection structure and its mating connector are mated with one another, wherein the electrical connector is adapted to define an air tight chamber between it and its mating connector when mated together, which air tight chamber encloses at least all the contact pin and associated contact elements.

BACKGROUND

Electrical connectors of the type described above are used, for example, in the automotive industry. The contact elements of the mating connector may be either contact pads or female elements such as bushings, which are engaged by the pins. The air-tight chamber prevents intrusion of moisture which could degrade the contact surfaces. In order to obtain an air-tight chamber when the electrical connector and its mating connector are engaged with one another, there can be an integrated sealing system or a separate seal made from EPDM (Ethylene Propylene Diene Monomer) rubber and the like between the electrical connector and its mating connector.

The inventors of the present invention have recognized that even the residual moisture within the connector can cause degradation of the contacts, in particular when there are silver contacts, and that the reason for this is electrical "silver migration" which may occur on silver contacts which are exposed to moisture, even when its quantity is very small.

WO 2007/036369 A1 discloses to use within vehicle electrical systems a moisture absorbing material, for example water absorbing polymers, which are polymers that can absorb and retain extremely large amounts of liquids relative to their own mass. Suitable polymers would be polyacrylate, for example acrylic acid which is neutralized by sodium. The moisture absorbing material has to be applied on single wires and feedthroughs during the assembly of the vehicle electrical systems. If a workman would forget such a treatment, moisture protection would be insufficient.

The object of the present invention is to provide an electrical connector of the above mentioned type which would reliably prevent silver migration without any additional mounting steps.

SUMMARY

According to the invention, at least one of the pins is not for electrical connection and comprises a moisture absorbing material, while the other pins are contact pin for establishing the independent electrical connections. This increases the endurance of the electrical connections, because the moisture absorbing pin reduces residual moisture which has remained within the mated electrical connectors as well as some amount of moisture which would intrude anytime later, for example in harsh environments.

The moisture absorbing pin can easily be integrated within existing electrical connectors without any substantial modifications thereof, and it is not possible to forget the moisture absorbing pin when the electrical connector and its mating connector are engaged with one another.

The moisture absorbing pin can be fixedly mounted to the electrical connector, preferably in the same way as the contact pins. However, a steadily fixed moisture absorbing pin exposed to the atmosphere would gradually lose its ability to absorb moisture which would limit storability. In order to avoid this, it is possible to cover the moisture absorbing pin by a moisture-tight protective layer which is peeled of, for example by an opposite female element of the mating connector, when the electrical connector and its mating connector are fitted together.

According to an embodiment, exposure of the moisture absorbing pin to the atmosphere would be reduced in that, when the electrical connector and its mating connector are separated from each other (prior to being engaged with one another), the moisture absorbing pin is retracted within the electrical connector, and the electrical connector is adapted to drive the moisture absorbing pin outwardly toward the mating connector due to the action of fitting together the electrical connector and its mating connector. For example, the moisture absorbing pin can be retracted into a plastic main casing of the electrical connector which supports the pins and associated electrical conductors. The surrounding plastic casing would protect the moisture absorbing pin at least laterally more or less against moisture absorption.

Even in this case the moisture absorbing pin may absorb some moisture from the atmosphere, at least at its front end. In order to prevent this, it is proposed to include a shield for shielding the moisture absorbing pin against the atmosphere when it is retracted within the electrical connector. For example, the sealing means could be some door mechanism or simply a sealing coating or rubber plug at the front end of the moisture absorbing pin, or the moisture absorbing pin could include a moisture absorbing material only in areas which are completely and tightly encapsulated by some portions of the electrical connector when in the retracted state.

According to a further embodiment, the moisture absorbing pin is driven outwardly from its retracted state and toward the mating connector by the force acting on the contact pins as the electrical connector is fitted into mating engagement with its mating connector. Such forces occur for contact plate pins, which require a certain length of compression in order to make a reliable electrical contact with the associated pad contact element, as well as for sliding contacts in the course of their sliding motion into female elements. Alternatively to said driving outward by the force acting on the contact pins, the moisture absorbing pin could be driven outward by some biased spring mechanism which is released by the action of engaging the electrical connector with its mating connector, thus the moisture absorbing pin would be urged outward from its retracted state.

According to a further embodiment, the electrical connector includes transmission means for transmission of the force acting on the contact pins to the moisture absorbing pin. The transmission means can be hydraulic means, in particular a volume filled with a fluid and interconnecting the back surfaces of all or some of the pins in order to transmit a force acting on the contact pins into a force acting on and driving out the moisture absorbing pin. Such a fluid may have a certain viscosity, like a grease or a gel, in order to impede leaking out from the volume. Alternatively, the transmission means can be mechanical means, in particular lever means, which are actuated by the contact pins or by some portion of the mating connector when the electrical connector and its mating connector are fitted together.

A mechanism for driving out the moisture absorbing pin could be constructed in such a way that it also retracts the moisture absorbing pin into the electrical connector by the action of separating the electrical connector from its mating connector. However, if it is expected that the electrical connector and its mating connector after the first fitting together would not or only shortly be separated from each other, it may suffer to construct said mechanism for only a single driving out operation.

A preferred moisture absorbing material of or within the moisture absorbing pin is water absorbing polymer, in particular sodium polyacrylate.

Preferably, the electrical connector according to the invention is of a contact plate type wherein a plastic main casing supports silver contact pins and one moisture absorbing pin as well as associated electrical conductors and includes a plate-shaped part which is adapted for mechanical fastening to the mating connector.

In the following an embodiment of the invention is described in detail with reference to the drawings, in which:

DETAILED DESCRIPTION

Figure 1:
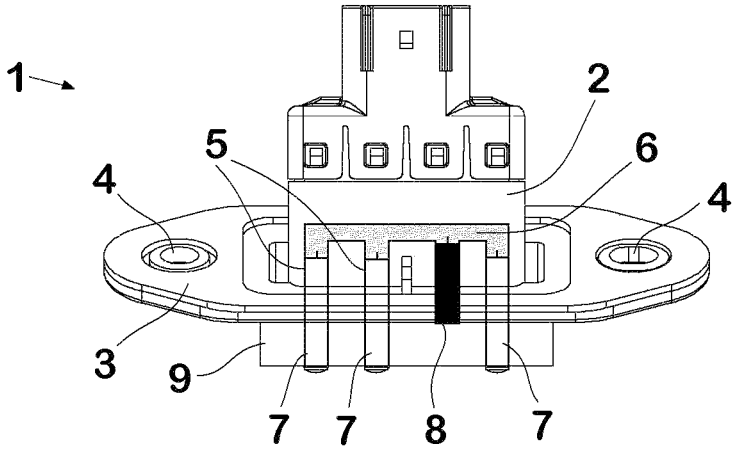
FIG. 1 is a perspective view taken laterally from the cable side of an electrical connector having a moisture absorbing pin.
Figure 2:
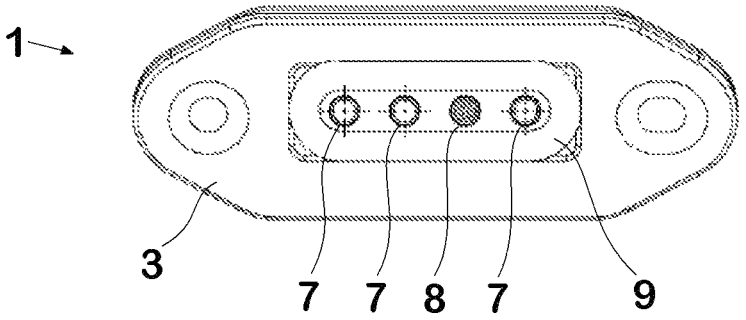
FIG. 2 is a perspective view of the electrical connector taken from the pin side.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

An electrical connector 1 for mechanical and electrical connection with a mating connector (not shown) comprises a main casing 2 (preferably made of plastic) which is encircled by a plate-shaped part 3 having through-holes 4 for mechanical fastening to the mating connector by means of screws or other fasteners known in the art.

In the casing 2 there are formed four parallel cylindrical holes 5 in one row which are connected by a traverse channel 6. In three of the holes 5 there are located metal contact pins 7 (which may be silver-coated), respectively, and in one of the holes 5 there is located a moisture absorbing pin 8 which consists of or contains a water absorbing polymer such as sodium polyacrylate.

The volumes of the parallel holes 5 behind (above as viewed in FIG. 1) the pins 7, 8 and the traverse channel 6 together define a common volume which interconnects the back surfaces of the pins 7, 8 and which is filled with a fluid. The pins 7, 8 are fitted in the holes 5 in a manner that they are movable along their respective axes but that the fluid cannot escape from the volume. What is not shown in the drawings is that the contact pins 7 are connected electrically with wires which run upwards into a cable leading away from the main casing 2.

The contact pins 7 project partially from the main casing 2 for engagement with respective contact elements (not shown) of the mating connector. The projecting parts of the contact pins 7 are laterally surrounded by an oblong-shaped projecting wall 9 of the main casing 2 which is adapted to cooperate with corresponding structure of the mating connector in order to form an air-tight connection with the mating connector. Thus, the chamber around the pins 7, 8 would be separated from the atmosphere (air-tight) when the electrical connector 1 and its mating connector are matingly engaged with one another to achieve electrical continuity between contact pins 7 and the contact elements of the mating connector.

The moisture absorbing pin 8 is somewhat shorter than the contact pins 7 such that it does not project from the main casing 2 prior to the electrical connector 1 and its mating connector being fitted together into engagement with one another. This original position of moisture absorbing pin 8 in which it does not project substantially from the main casing, as shown in FIG. 1, is referred to as a retracted position.

As the electrical connector 1 and its mating connector are urged into mating engagement with one another, the contact elements of the mating connector which are associated with and engage the contact pins 7 exert forces onto the contact pins 7, pushing them backward against the fluid. These forces are transmitted by the fluid onto the moisture absorbing pin 8 such that the moisture absorbing pin 8 is driven outward from the retracted position in the main casing 2 and toward the mating connector. Because of the shown hydraulic design, relatively small movement of the three contact pins 7 are multiplied and cause a relatively greater movement of the moisture absorbing pin 8 outward from the main casing 2. The position of moisture absorbing pin 8 in which it projects into the chamber is referred to as an extended position.

Subsequently, after the connector 1 and the mating connector are mated with one another, the projecting moisture absorbing pin 8 absorbs any residual moisture in the air within the air-tight chamber around the pins 7, 8. Thus, silver migration between the metal contact pins 7 by humidity is prevented or at least decreased.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical connector comprising:

a casing configured to define an air-tight chamber when mated with a mating connector;

a plurality of contact pins projecting from the casing to make contact with respective contact elements of the mating connector within the chamber when mated with the mating connector; and a moisture-absorbing pin projecting from the casing into the chamber.

2. The electrical connector of claim 1, wherein the moisture-absorbing pin is retained in a retracted position relative to the electrical connector prior to mating of the electrical connector and the mating connector, and mating of the electrical connector with the mating connector urges the moisture-absorbing pin toward the mating connector and into the chamber.

3. The electrical connector of claim 2, wherein the moisture-absorbing pin is urged into the chamber by a force applied to the contact pins by movement of the mating connector into mating engagement with the electrical connector.

4. The electrical connector of claim 3, wherein the electrical connector further comprises a fluid that is compressed by at least one of the contact pins during engagement of the electrical connector with the mating connector, compression of the fluid urging the moisture absorbing pin into the chamber.

5. The electrical connector of claim 1, wherein the contact pins are silver coated.

6. The electrical connector of claim 1, wherein the moisture-absorbing pin comprises a water absorbing polymer.

7. The electrical connector of claim 6, wherein the water absorbing polymer is sodium polyacrylate.

8. An electrical connector comprising:

a casing configured to define a chamber when mated with a mating connector;

a plurality of contact pins projecting from the casing into the chamber when mated with the mating connector; and a moisture-absorbing pin retained by the casing for movement between a retracted position wherein the moisture-absorbing pin is substantially enclosed by the casing and an extended position wherein the moisture-absorbing pin extends into the chamber.

9. The electrical connector of claim 8, wherein the moisture-absorbing pin is urged from the retracted position to the extended position by a force applied to the contact pins by movement of the mating connector into mating engagement with the electrical connector.

10. The electrical connector of claim 9, wherein the electrical connector further comprises a fluid that is compressed by at least one of the contact pins during engagement of the electrical connector with the mating connector, compression of the fluid urging the moisture absorbing pin into the chamber.

11. The electrical connector of claim 8, wherein the contact pins are silver coated.

12. The electrical connector of claim 8, wherein the moisture-absorbing pin comprises a water-absorbing polymer.

13. The electrical connector of claim 12, wherein the water-absorbing polymer is sodium polyacrylate.

14. An electrical connector comprising:

a casing configured to define a chamber when mated with a mating connector;

a plurality of contact pins projecting from the casing into the chamber when mated with the mating connector;

a moisture-absorbing pin retained by the casing for movement between a retracted position wherein the moisture-absorbing pin is substantially enclosed by the casing and an extended position wherein the moisture-absorbing pin extends into the chamber; and a fluid contained within the casing that is compressed by a movement of at least one of the contact pins during engagement of the electrical connector with the mating connector, compression of the fluid urging the moisture absorbing pin from the retracted position to the extended position.

15. The electrical connector of claim 14, wherein the contact pins are silver coated.

16. The electrical connector of claim 14, wherein the moisture-absorbing pin comprises a water-absorbing polymer.

17. The electrical connector of claim 16, wherein the water-absorbing polymer is sodium polyacrylate.

* * * * *